US006300288B1

(12) United States Patent
Scharf et al.

(10) Patent No.: US 6,300,288 B1
(45) Date of Patent: Oct. 9, 2001

(54) FUNCTIONALIZED POLYMER AS GREASE ADDITIVE

(75) Inventors: Curtis R. Scharf, Wickliffe; Steven R. Twining, Lakewood; Patricia R. Todd, Chardon, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 08/221,324

(22) Filed: Mar. 31, 1994

(51) Int. Cl.[7] ..... C10M 113/00; C10M 117/00; C10M 121/00; C10M 145/00

(52) U.S. Cl. ..... 508/221; 508/232; 508/233; 508/241; 508/452; 508/466; 508/507

(58) Field of Search ..... 252/35, 36, 39, 252/40, 41, 56 D; 508/221, 232, 233, 241, 452, 466, 507

(56) References Cited

U.S. PATENT DOCUMENTS

| | | | | |
|---|---|---|---|---|
| 2,991,249 | | 7/1961 | Andress | 252/40 |
| 3,412,027 | | 11/1968 | Morway | 252/40.7 |
| 3,476,532 | | 11/1969 | Hartman | 44/7 |
| 3,591,499 | | 7/1971 | Morway | 252/39 |
| 3,801,506 | | 4/1974 | Cross et al. | 252/40 |
| 3,809,647 | | 5/1974 | Baudouin | 252/28 |
| 4,033,888 | * | 7/1977 | Kiovsky | 252/56 D |
| 4,141,847 | * | 2/1979 | Kiovsky | 252/51.5 A |
| 4,160,739 | * | 7/1979 | Stambaugh et al. | 252/56 D |
| 4,161,452 | * | 7/1979 | Stambaugh et al. | 252/56 D |
| 4,427,828 | * | 1/1984 | Hergenrother et al. | 525/183 |
| 4,517,104 | | 5/1985 | Bloch | 252/51.5 |
| 4,578,429 | * | 3/1986 | Gergen et al. | 525/291 |
| 4,670,173 | | 6/1987 | Hayashi et al. | 252/51.5 |
| 4,749,500 | | 6/1988 | Forsbeg | 252/49.3 |
| 4,877,557 | | 10/1989 | Kaneshige et al. | 252/47.5 |
| 4,929,371 | | 5/1990 | Waynick | 252/25 |
| 5,110,489 | | 5/1992 | Stadler et al. | 252/35 |
| 5,110,490 | | 5/1992 | Pink et al. | 252/17 |
| 5,167,848 | | 12/1992 | Chung | 252/51.5 |
| 5,275,747 | | 1/1994 | Gutierrez et al. | 252/51.5 |
| 5,277,833 | * | 1/1994 | Song et al. | 252/56 |

FOREIGN PATENT DOCUMENTS

| | | | |
|---|---|---|---|
| 500927 | | 6/1979 | (AU) . |
| 84910 | | 8/1983 | (EP) . |
| 0275658 | * | 7/1988 | (EP) . |
| 0394033 | | 10/1990 | (EP) . |
| 0440506 | | 2/1991 | (EP) . |
| 8703890 | | 7/1987 | (WO) . |

OTHER PUBLICATIONS

"Alteration of Grease Characteristics with New Generation Polymers," Hussey, National Lubricating Grease Institute, Oct. 26–29, 1986.

"Modern Lubricating Greases," C.J. Boner, Scientific Publications (GB) Ltd. (No date available).

* cited by examiner

*Primary Examiner*—Margaret Medley
(74) *Attorney, Agent, or Firm*—David M. Shold; Michael F. Esposito

(57) ABSTRACT

A grease of an oil of lubricating viscosity, a polyolefin having grafted acid functionality, a metallic species capable of interacting with the acid functionality of said polyolefin to cause association among the acid groups and a co-thickening agent, has improved rheological properties. The co-thickening agent and the metallic species can together comprise a gelled overbased material, particularly an overbased carboxylate.

31 Claims, No Drawings

FUNCTIONALIZED POLYMER AS GREASE ADDITIVE

BACKGROUND OF THE INVENTION

The present invention relates to grease compositions which contain a functionalized polymer which serves as a thickener or rheology modifier.

Greases typically comprise a base oil and a thickener, which is normally an acid-containing material. In some instances polymers also have been added to grease compositions in an attempt to improve performance characteristics such as dropping points, cone penetration, water wash-off, or oil separation.

U.S. Pat. No. 3,591,499, Morway, Jul. 6, 1971, discloses a grease containing a metal salt of an α,ω-dicarboxylic acid of molecular weight 500–2500. The metal can be an alkali metal or alkaline earth metal. The salts of the branched carboxy-terminated dicarboxylic acids are more shear stable than is polyisobutylene, yet are still capable of imparting adhesiveness and stringiness to a grease. At the same time, these salts per se are capable of thickening oil to a grease structure.

U.S. Pat. No. 3,476,532, Hartman, Nov. 4, 1969, discloses metal-containing complexes of oxidized polyethylene, containing functional oxygen groups e.g. carbonyl, carboxyl, hydroxy, etc. The material is useful in production of grease-like compositions. The composition is a mixture of the oxidized poly-ethylene and a complexing agent selected from metal salts, metal salts of fatty acids, the metals being at least divalent, and metal complexes.

U.S. Pat. No. 4,877,557, Kaneshige et al., Oct. 31, 1989, discloses a lubricating oil composition comprising a synthetic hydrocarbon lubricating oil, a load withstanding additive, and a liquid modified ethylene/α-olefin random copolymer. The load withstanding additive is roughly divided into an oiliness agent and an extreme pressure agent. The oiliness agent can be higher fatty acids such as oleic acid and stearic acid. Extreme pressure agents include, for example, organic metal type extreme pressure agents. The load-withstanding additives can be used singly or in the form of a mixture of two or more of them. The liquid copolymer is prepared from an unmodified polymer with a number average molecular weight of 300 to 12,000.

Australian application 500,927, published in 1978 or 1979, discloses a lubricating grease comprising a paraffinic mineral oil, a calcium complex soap thickener, and an organic terpolymer of 65% ethylene, 5% ester comonomer, and 0.01–3% acid comonomer, melt index 0.5 to 200.

U.S. Pat. No. 5,275,747, Gutierrez et al., Jan. 4, 1994, discloses a derivatized ethylene alpha olefin polymer useful as a multifunctional viscosity index improver additive for oleaginous compositions. The alpha-olefin polymer is terminally unsaturated and has a number average molecular weight of above 20,000 to about 500,000. It is substituted with mono-or dicarboxylic acid-producing moieties; it can be reacted with metals to form salts. The additive has multifunctional viscosity index improver properties and can be used by incorporation and dissolution into an oleaginous material such as lubricating oils. Other additives may also be present; crankcase compositions can contain 2 to 8000 parts per million of calcium or magnesium, generally present as basic or neutral detergents.

In the present invention an acid-functionalized polymer is incorporated into a grease composition to provide thickening and improve the performance of the composition.

SUMMARY OF THE INVENTION

The present invention provides a composition comprising an oil of lubricating viscosity; a polyolefin having grafted acid functionality, said polyolefin having a number average molecular weight of at least about 50,000; a metallic species capable of interacting with the acid functionality of said polyolefin to cause association among the acid groups; and a co-thickening agent; said polyolefin being present in an amount sufficient to increase the viscosity of the composition. The invention also provides a composition comprising a gelled overbased material dispersed in an oleophilic liquid medium; and a polymer containing acid functionality, present in an amount sufficient to increase the viscosity of the composition. The invention further provides a concentrate consisting essentially of a polyolefin having grafted carboxylic acid functionality, said polyolefin having a number average molecular weight of at least about 50,000; a co-thickening agent; and a concentrate-forming amount of an oleophilic medium. Further, the present invention provides a method for preparing a grease, comprising combining an oil of lubricating viscosity; a polyolefin having grafted acid functionality, said polyolefin having a number average molecular weight of at least about 50,000; a metallic species capable of interacting with the acid functionality of said polyolefin to cause association among the acid groups; and a co-thickening agent.

DETAILED DESCRIPTION OF THE INVENTION

Greases are typically prepared by thickening an oil basestock. The greases of this invention are oil-based, that is, they comprise an oil which has been thickened with a thickener, also referred to as a thickening agent. Greases are generally distinguished from oils in that they exhibit a yield point (at room temperature or at the temperature of use) while oils do not. That is, below a certain level of applied stress, greases will generally not flow; whereas oils will flow under an arbitrarily small stress, if very slowly. In practice this often means that greases cannot be poured and appear to be a solid or semisolid, while oils can be poured and have the characteristics of a fluid, even if a very viscous fluid. Compositionally, greases are often heterogeneous compositions, comprising a suspension of one material, often a fibrous crystalline material, in another. Oils, on the other hand, are normally more uniform, at least on a macroscopic scale, often comprising an apparently homogeneous solution of materials. Oils often exhibit Newtonian flow behavior; greases do not.

The oil of lubricating viscosity.

The grease compositions of this invention employ an oil of lubricating viscosity, including natural or synthetic lubricating oils and mixtures thereof. Natural oils include animal oils, vegetable oils, mineral oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

Specific examples of oils of lubricating viscosity are described in U.S. Pat. No. 4,326,972 and European Patent Publication 107,282. A basic, brief description of lubricant base oils appears in an article by D. V. Brock, "Lubricant Base Oils," *Lubricant Engineering* volume 43, pages 184–185, March 1987. A description of oils of lubricating viscosity occurs in U.S. Pat. No. 4,582,618 (Davis) (column 2, line 37 through column 3, line 63, inclusive). Another source of information regarding oils used to prepare lubricating greases is *NLGI Lubricating Grease Guide*, National Lubricating Grease Institute, Kansas City, Mo. (1987), pp. 1.06–1.09.

The co-thickening agent.

Grease thickeners are well known in the art of grease formulation, and they comprise one of the major components of the present invention. In the context of the present invention, however, the thickener or thickening agent can be referred to as a co-thickener or co-thickening agent. This is because the co-thickener, when present, does not provide the sole or necessarily even the primary source of the thickening of the grease. A significant amount, and sometimes the major amount, of the thickening is provided rather by a polyolefin having grafted acid functionality. This polymer, described in detail below, is believed to provide thickening in part through its interaction with metallic species which are also present in the composition and which are capable of interacting with the acid functionality of the polyolefin.

Conventional grease thickeners (i.e., the co-thickeners) can be categorized as simple metal soap thickeners, soap complexes, and non-soap thickeners. Simple metal soap thickeners are well known in the art. The term "simple metal soaps" is generally used to indicate the substantially stoichiometrically neutral metal salts of fatty acids. By substantially stoichiometrically neutral is meant that the metal salt contains 90% to 110% of the metal required to prepare the stoichiometrically neutral salt, preferably about 100%, e.g., 95% to 102%. Thus, the co-thickening agent of the present invention can be a metal soap or an acidic material (including fatty acids, described below) which interacts with a metallic species to form a metal soap. The metallic species can be pre-reacted with the acidic material to form the soap before it is added to the grease composition, or the acidic material can be reacted in situ with the metallic species which is supplied as component (c) of the present invention.

Fatty acids are defined herein as carboxylic acids containing from 8 to 24, preferably from 12 to 18 carbon atoms. The fatty acids are usually monocarboxylic acids. Examples of useful fatty acids are capric, palmitic, stearic, oleic and others. Mixtures of acids are useful. Preferred carboxylic acids are linear; that is they are substantially free of hydrocarbon branching.

Particularly useful acids are the hydroxy-substituted fatty acids such as hydroxy stearic acid wherein one or more hydroxy groups may be located at positions internal to the carbon chain, such as 12-hydroxy-, 14-hydroxy- etc. stearic acids.

While the soaps are fatty acid salts, they need not be, and frequently are not, prepared directly from fatty acids. The typical grease-making process involves saponification of a fat which is often a glyceride or of other esters such as methyl or ethyl esters of fatty acids, preferably methyl esters, which saponification is generally conducted in situ in the base oil making up the grease.

Whether the metal soap is prepared from a fatty acid or an ester such as a fat, greases are usually prepared in a grease kettle, by forming a mixture of the base oil, fat, ester or fatty acid and metal-containing reactant to form the soap in situ. Additives for use in the grease may be added during grease manufacture, but are often added following formation of the base grease.

The metals of the metal soaps are typically alkali metals, alkaline earth metals and aluminum. For purposes of cost and ease of processing, the metals are sometimes incorporated into the thickener by reacting the fat, ester or fatty acid with basic metal containing reactants such as oxides, hydroxides, carbonates and alkoxides (typically lower alkoxides, those containing from 1 to 7 carbon atoms in the alkoxy group). The soap may also be prepared from the metal itself although many metals are either too reactive or insufficiently reactive with the fat, ester or fatty acid to permit convenient processing. Preferred metals are lithium, sodium, calcium, magnesium, barium and aluminum. Especially preferred are lithium, aluminum and calcium; lithium is particularly preferred.

Preferred fatty acids are stearic acid, palmitic acid, oleic and their corresponding esters, including glycerides (fats). Hydroxy-substituted acids and the corresponding esters, including fats are particularly preferred.

Complex greases are those which are prepared using soap-salt complexes as the thickening agent, and are likewise well known to those skilled in the art. Soap-salt complexes comprise a salt of a fatty acid and a non-fatty acid. Fatty acids have been described in detail above; non-fatty acids typically include short chain (e.g. 6 or fewer carbon atoms) alkanoic acids such as acetic acid; benzoic acid; and diacids such as azeleic acid and sebaeic acid. Sometimes medium weight acids (e.g. caprylic, capric) are also included in the mixture. Examples of such soap complex thickeners, then, include metal soap-acetates, metal soap-dicarboxylates, and metal soap-benzoates. Widely-used soap-salt complexes include aluminum stearate-aluminum benzoate, calcium stearate-calcium acetate, barium stearate-barium acetate, and lithium 12-hydroxystearate-ithium azelate.

Preparation of complex greases is well known. In some instances (calcium complex greases, for example) a short-chain alkanoic acid is reacted with a metal base (e.g., lime) while the fatty acid salt is being formed. Alternatively, a two-step process can be employed, in which a normal soap is formed, which is then "complexed" by reaction with additional metal base and low weight acid. In other instances the procedure can be more complicated, if for example the acids and bases do not efficiently react together directly. Various methods of preparing complex greases are described, in more detail on pages 2.13–2.15 of the above-mentioned *NLGI Lubricating Grease Guide.*

Non-soap greases are prepared using non-soap thickeners. These include inorganic powders such as organo-clays, fine fumed silicas, fine carbon blacks, and pigments such as copper phthalocyanine. Other non-soap greases employ polymeric thickeners such as polyureas. The polyureas can be formed in situ in the grease by mixing oil with suitable amines in a grease kettle, and slowly adding an oil solution of an isocyanate or a diisocyanate. Non-soap thickeners are described in pages 2.15–2.17 of *NLGI Lubricating Grease Guide.*

In traditional grease formulation, thickeners are incorporated into a base oil, typically, an oil of lubricating viscosity in amounts typically from 1 to 30% by weight, more often from 1 to 15% by weight, of the base grease composition. In many cases, the amount of thickener used to thicken the base oil constitutes from 5% to 25% by weight of base grease. In other cases from 2% to 15% by weight of thickener is present in the base grease. The specific amount of thickener required often depends on the thickener employed. The type and amount of thickener employed is frequently dictated by the desired nature of the grease. The type and amount are also dictated by the desired consistency, which is a measure of the degree to which the grease resists deformation under application of force. Consistency is usually indicated by the ASTM Cone penetration test, ASTM D-217 or ASTM D-1403. Types and amounts of thickeners to employ are well known to those skilled in the grease art and are further described in the *NLGI Lubricating Grease Guide*. Since, in the present invention, the functionalized polyolefin provides a significant portion of the thickening property of the grease, it is possible to reduce the amount of the co-thickening agent by an appropriate amount, compared with the above-listed amounts. Thus the amounts of the co-thickener can typically be reduced by 50%.

It is possible that the co-thickening agent can be an acid-functionalized oil or the reaction product of an acid functionalized oil with a metallic species. Acid functionalized oil can be prepared as a byproduct of the grafting reaction whereby the acid-grafted polyolefin, component (b) of the present invention, is prepared. If an olefin polymer is grafted by a solvent-based free radical reaction, for example, described in greater detail below, the solvent can be a mineral oil. If this is the case, a certain amount of acid functionality may become attached to the hydrocarbon chain of the oil in much the same way that it is grafted onto the polymer. The hydrocarbon chains in an oil are normally much shorter than those in an olefin polymer, and the end result can be a mixture of fatty acid molecules in an oil medium. Alternatively, acid-functionalized oil can be prepared by subjecting mineral oil by itself to grafting conditions as described below. The functionalized oil molecules which result, in any event, can function as a co-thickening agent. They may be isolated and added separately, if desired, or they can be added as a part of the medium in which the acid-grafted polyolefin is supplied.

The grafted polyolefin.

The polyolefin of the present invention is a polyolefin onto which has been grafted acid functionality. The polyolefin onto which the acid functionality is grafted is a polymer which consists in its main chain essentially of olefin monomers, and preferably α-olefin monomers. The polyolefins of the present invention thus exclude polymers which have a large component of other types of monomers copolymerized in the main polymer backbone, such as ester monomers, acid monomers, and the like.

The polymers employed in this invention can be polymers of ethylene and at least one other α-olefin having the formula $H2C{=}CHR^1$ wherein $R^1$ is straight chain or branched chain alkyl radical comprising 1 to 18 carbon atoms. Preferably $R^1$ in the above formula is alkyl of from 1 to 8 carbon atoms, and more preferably is alkyl of from 1 to 2 carbon atoms. Therefore, useful comonomers with ethylene in this invention include propylene, 1-butene, hexene-1, octene-1, 4-methyl-pentene-1, decene-1, dodecene-1, tridecene-1, tetradecene-1, pentadecene-1, hexadecene-1, heptadecene-1, octadecene-1, nonadecene-1 and mixtures thereof (e.g., mixtures of propylene and 1-butene, and the like).

Exemplary of such polymers are ethylene-propylene copolymers, ethylene-butene-1 copolymers and the like. Preferred polymers are copolymers of ethylene and propylene and ethylene and butene-1. Other preferred polymers are α-olefin-diene polymers, including ethylene-propylene diene ("EPDM") polymers and styrene diene polymers such as styrene-butadiene rubber polymers.

The styrene-diene copolymers are prepared from styrenes such as styrene, alpha-methyl styrene, ortho-methyl styrene, meta-methyl styrene, para-methyl styrene, para-tertiary butyl styrene, etc. Preferably the diene is a conjugated diene which contains from 4 to 6 carbon atoms. Examples of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The styrene content of these copolymers is typically in the range of about 20% to about 70% by weight, preferably about 40% to about 60% by weight. The aliphatic conjugated diene content of these copolymers is typically in the range of about 30% to about 80% by weight, preferably about 40% to about 60% by weight.

Styrene-diene copolymers can be prepared by methods well known in the art. Such copolymers usually are prepared by anionic polymerization using, for example, an alkali metal hydrocarbon (e.g., sec-butyllithium) as a polymerization catalyst. Other polymerization techniques such as emulsion polymerization can be used.

The polymers, and in particular styrene-diene copolymers, can be random copolymers, block copolymers, or random block copolymers. Random copolymers are those in which the comonomers are randomly or nearly randomly arranged in the polymer chain; block copolymers are those in which one or more relatively long chains of one type of monomer are joined to one or more relatively long chains of another type; and random block copolymers are those in which relatively shorter chains of one type monomer alternate with similar chains of another type. Another type of suitable polymer is radial or "star" polymers.

Diene-containing copolymers can be hydrogenated in solution so as to remove a substantial portion of their olefinic double bonds. Techniques for accomplishing this hydrogenation are well known to those of skill in the art and need not be described in detail at this point. Briefly, hydrogenation is accomplished by contacting the copolymers with hydrogen at super-atmospheric pressures in the presence of a metal catalyst such as colloidal nickel, palladium supported on charcoal, etc. In general, it is preferred that these copolymers, for reasons of oxidative stability, contain no more than about 5% and preferably no more than about 0.5% residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the aforementioned-mentioned analytical techniques.

Certain ethylene-propylene polymers and certain styrene-butadiene polymers are well known elastomers which are commercially available from a variety of sources.

If the olefin polymer is an ethylene polymers, the molar ethylene content is preferably in the range of 20 to 80 percent, and more preferably 30 to 70 percent. When propylene and/or butene-I are employed as comonomer(s) with ethylene, the ethylene content of such copolymers is most preferably 45 to 65 percent, although higher or lower ethylene contents may be present. Most preferably, the polymers used in this invention are substantially free of ethylene homopolymer and exhibit a degree of crystallinity such that, when functionalized, they are readily soluble in mineral oils.

The polymers employed in this invention generally possess a number average molecular weight of at least greater than 50,000, preferably at least 100,000, more preferably at least 150,000, and most preferably at least 200,000. Generally, the polymers should not exceed a number average molecular weight of 500,000, preferably 400,000, and more preferably 300,000. The number average molecular weight for such polymers can be determined by several known techniques. A convenient method for such determination is by size exclusion chromatography (also known as gel permeation chromatography (GPC)) which additionally provides molecular weight distribution information, see W. W. Yau, J. J. Kirkland and D. D. Bly, "Modern Size Exclusion Liquid Chromatography", John Wiley and Sons, New York, 1979.

A measurement which is complementary to a polymer's molecular weight is the melt index (ASTM D-1238). Polymers of high melt index generally have low molecular weight, and vice versa. The grafted polymers of the present invention preferably have a melt index of up to 20 dg/min, more preferably 0.1 to 10 dg/min.

The polymers employed in this invention may generally be prepared substantially in accordance with procedures which are well known in the art. The polymers for use in the present invention can thus be prepared by polymerizing monomer mixtures comprising olefins such as alpha-olefins having from 3 to 20 carbon atoms, including monoolefins such as propylene, 1-butene, 2-butene, isobutene, 1-pentene, 1-hexene, 1-heptene, 1-octene, 1-nonene, 1-decene, 2, pentene, propylene tetramer, diisobutylene, and triisobutylene; diolefins such as 1,3-butadiene, 1,2-pentadiene, 1,3-penatdiene, isoprene, 1,5-hexadiene, 2-chloro-1,3 butadiene, aromatic olefins such as styrene, α-methyl styrene, ortho-methyl styrene, meta-methyl styrene, para-methyl styrene, and para-t-butyl styrene; and mixtures thereof) in the presence of a catalyst system, described below. The comonomer content can be controlled through the selection of the catalyst component and by controlling the partial pressure of the various monomers. The resulting polymers can be poly-α-olefins including random copolymers, block copolymers, and random block copolymers.

The catalysts employed in the production of the reactant polymers are likewise well known. One broad class of catalysts, particularly suitable for polymerization of α-olefins, is generally known as coordination catalysts or Ziegler-Nata catalysts, and comprises a metal atom with certain complexing ligands.

Polymerization using coordination catalysis is generally conducted at temperatures ranging between 20° and 300° C., preferably between 30° and 200° C. Reaction time is not critical and may vary from several hours or more to several minutes or less, depending upon factors such as reaction temperature, the monomers to be copolymerized, and the like. One of ordinary skill in the art may readily obtain the optimum reaction time for a given set of reaction parameters by routine experimentation. Preferably, the polymerization will be completed at a pressure of 1 to 300 MPa (10 to 3,000 bar), and generally at a pressure within the range of 4 to 200 MPa (40 to 2,000 bar), and most preferably, the polymerization will be completed at a pressure within the range of 5 to 150 MPa (50 to 1,500 bar).

After polymerization and, optionally, deactivation of the catalyst (e.g., by conventional techniques such as contacting the polymerization reaction medium with water or an alcohol, such as methanol, propanol, isopropanol, etc., or cooling or flashing the medium to terminate the polymerization reaction), the product polymer can be recovered by processes well known in the art. Any excess reactants may be flashed off from the polymer.

Polymerization can also be effected using free radical initiators in a well-known process, generally employing higher pressures than are used with coordination catalysts.

The polymerization may be conducted employing liquid monomer, such as liquid propylene, or mixtures of liquid monomers (such as mixtures of liquid propylene and 1-butene), as the reaction medium. Alternatively, polymerization may be accomplished in the presence of a hydrocarbon inert to the polymerization such as butane, pentane, isopentane, hexane, isooctane, decane, toluene, xylene, and the like.

In those situations wherein the molecular weight of the polymer product that would be produced at a given set of operating conditions is higher than desired, any of the techniques known in the prior art for control of molecular weight, such as the use of hydrogen and/or polymerization temperature control, may be used in the process of this invention. If so desired, the polymerization may be carried out in the presence of hydrogen to lower the polymer molecular weight.

However, the polymers are preferably formed in the substantial absence of added $H_2$ gas, that is, the absence of $H_2$ gas added in amounts effective to substantially reduce the polymer molecular weight. More preferably, the polymerizations will be conducted employing less than 5 parts per million by weight, and more preferably less than 1 ppm, of added $H_2$ gas, based on the moles of the olefin monomers charged to the polymerization zone.

When carrying out the polymerization in a batch-type fashion, the reaction diluent (if any) and the alpha-olefin comonomer(s) are charged at appropriate ratios to a suitable reactor. Care should be taken that all ingredients are dry, with the reactants typically being passed through molecular sieves or other drying means prior to their introduction into the reactor. Subsequently, either the catalyst and then the cocatalyst (if any), or first the cocatalyst and then the catalyst are introduced while agitating the reaction mixture, thereby causing polymerization to commence. Alternatively, the catalyst and cocatalyst may be premixed in a solvent and then charged to the reactor. As polymer is being formed, additional monomers may be added to the reactor. Upon completion of the reaction, unreacted monomer and solvent are either flashed or distilled off, if necessary by vacuum, and the low molecular weight copolymer withdrawn from the reactor.

The polymerization may be conducted in a continuous manner by simultaneously feeding the reaction diluent (if employed), monomers, catalyst and cocatalyst (if any) to a reactor and withdrawing solvent, unreacted monomer and polymer from the reactor so as to allow a residence time of ingredients long enough for forming polymer of the desired molecular weight; and separating the polymer from the reaction mixture.

The grafted acid functionality on the polyolefin is derived from an ethyleneically unsaturated acid-containing reactant which can undergo graft reaction with the polyolefin. Suitable acids can include ethyleneically unsaturated sulfur-containing acids such as sulfonic acids, phosphorus-containing acids such as phosphonic acids, and carboxylic acids and their equivalents. Preferred acid monomers are carboxylic acids or their derivatives, particularly materials selected from the group consisting of (i) monounsaturated C4 to C10 dicarboxylic acid wherein (a) the carboxyl groups are vicinal, (i.e. located on adjacent carbon atoms) and (b) at least one, preferably both, of said adjacent carbon atoms are part of said mono unsaturation; (ii) derivatives of (i) such as anhydrides or C1 to C5 alcohol derived mono- or di-esters of (i); (iii) monounsaturated C3 to C10 monocarboxylic acid wherein the carbon-carbon double bond is allylic to the carboxy group, i.e., of the structure

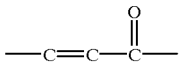

and (iv) derivatives of (iii) such as C1 to C5 alcohol derived mono- or di-esters of (iii). Upon reaction with the polymer, the monounsaturation of the monounsaturated carboxylic reactant becomes saturated. Thus, for example, use of maleic anhydride leads to a polymer substituted with succinic anhydride, and acrylic acid leads to a polymer substituted with propionic acid. If the polymer formed by reaction contains anhydride or ester functionality, such functionality should be converted to acid functionality in order for the polymer to be most effectively used in the present invention. This conversion can be readily conducted by well known hydrolysis methods.

Exemplary of such monounsaturated carboxylic reactants are fuimaric acid, itaconic acid, maleic acid, maleic anhydride, chloromaleic acid, chloromaleic anhydride, acrylic acid, methacrylic acid, crotonic acid, cinnamic acid, and lower alkyl (e.g., C1 to C4 alkyl) acid esters of the foregoing, e.g., methyl maleate, ethyl fumarate, methyl fuimarate, etc. Maleic acid and its derivatives are particularly suitable.

Typically, 0.01 to 50 g of said monounsaturated carboxylic reactant are charged to the reactor per kg of polymer charged; more commonly the amount would be 0.1 to 5 g.

Not all of the polymer will necessarily react with the monounsaturated carboxylic reactant, in which case the reaction mixture will contain unreacted polymer. The unreacted polymer is typically not removed from the reaction mixture, but the product mixture, stripped of any monounsaturated carboxylic reactant, is employed as described hereinafter. Characterization of the average number of moles of monounsaturated carboxylic reactant which have reacted per mole of polymer charged to the reaction (whether it has undergone reaction or not) is based upon (i) determination of the saponification number of the resulting product mixture using potassium hydroxide; and (ii) the number average molecular weight of the polymer charged, using techniques well known in the art. This characterization is defined with reference to the resulting product mixture. The term "polyolefin having grated acid functionality" is intended to refer to the product mixture whether or not it contains any unreacted polymer chains.

Accordingly, the amount of carboxylic acid functionality on the grafted polyolefin will normally be 0.001 to 5.5 weight percent, by which it is meant that —COOH groups will comprise this weight percent of the grafted polyolefin. It is preferred that the amount of carboxylic acid functionality will be 0.01 to 2 weight percent, and more preferably 0.1 to 1 weight percent.

The monounsaturated carboxylic reactant an be reacted with (grafted to) the polyolefin by a variety of methods. For example, the polymer can be first halogenated, chlorinated or brominated to 0.05 to 2 wt. %, preferably 0.1 to 1 wt. % chlorine or bromine, based on the weight of polymer, by passing the chlorine or bromine through the polymer at a temperature of 60° to 250° C., preferably 110° to 160° C., e.g. 120° to 140° C., for 0.5 to 10, preferably 1 to 7 hours. The halogenated polymer may then be reacted with sufficient monounsaturated carboxylic reactant at 100° to 250° C., usually 180° to 235° C., for about 0.5 to 10, e.g. 3 to 8 hours, so the product obtained will contain the desired amount of the monounsaturated carboxylic reactant per mole of the halogenated polymer. Processes of this general type are taught in U.S. Pat. Nos. 3,087,436; 3,172,892; 3,272,746. Alternatively, the polymer and the monounsaturated carboxylic reactant can be mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

Alternatively, the grafting reaction can be the reaction between the poly-olefin and the carboxylic reactant employing a free radical initiator. In this type of grafting reaction, a radical source such as dicumyl peroxide can extract a hydrogen atom from the polymer chain, leaving a free radical. The radical on the chain can interact with a point of ethylenic unsaturation in a graft comonomer and lead to addition of the comonomer to the chain. One or more comonomer molecules can be grafted to the polymer chain at such a radical site, although the formation of long side chains of numerous acid-containing monomers is not generally contemplated.

Free radical grafting can be by a solvent-free process or a solvent process. In a solvent-free process, the reaction temperature between the polyolefin and the carboxylic reactant will depend to some extent on the type of polyolefin as well as the type of initiator system used. Generally the reaction temperature is from 100 to 300° C., desirably 160 to 260° C., and preferably 220 to 260° C. Although not necessary, the reaction can be carried out in an inert atmosphere such as nitrogen.

The solvent-free reaction can take place in any suitable vessel, device, or apparatus without the presence of a solvent. The reaction can be suitably conducted in a blending device such as an extruder, a Banbury™ blender, a two-roll mill, or the like. The blending device can impart high mechanical energy, which can lead to scission of the chains of the polyolefin. Such chain scission is not necessarily desired, but it may be desired in situations where the molecular weight of the starting polyolefin is greater than desired and hence can be broken down to a suitable level. Alternatively, a high mechanical energy input may be desired if the viscous nature of the polyolefin requires high mechanical energy mixing for processing. High mechanical energy can be input by the same type of mixing devices noted above, to impart high torque to or masticate the ingredients. As a side reaction, it is thought that polymer chains so broken produce chain ends which serve as reaction sites for the carboxylic reactant. Thus it is speculated that high mechanical energy imparting devices create reaction sites in addition to those created by the free radical initiator.

In order to promote the reaction and to create reaction sites, free radical initiators are generally used. Two types of initiators include the various organic peroxides and the various organic azo compounds. The amount of initiator is generally 0.01 percent to 5.0 percent by weight of the polyolefin and carboxylic reactant, preferably 0.05 to 2.0 percent by weight. Typical organic peroxides include benzoyl peroxide, t-butyl peroxypivalate, 2,4-dichlorobenzoyl peroxide, decanoyl peroxide, propionyl peroxide, hydroxyheptyl peroxide, cyclohexanone peroxide, t-butyl perbenzoate, dicumyl peroxide; 2,5-dimethyl-2,5,di(t-butylperoxyl)-3-hexyne, 2,5-dimethyl-2,5-di(t-butylperoxyl)hexane, 2,5-dimethyl-2,5-dibenzoylperoxyhexane, t-butyl peroxide, cumene hydroperoxide, 2,5-dimethyl-2,5-di(hydroperoxy)hexane, t-butyl hydroperoxide, lauroyl peroxide, t-amyl perbenzoate, and mixtures thereof Preferred organic peroxides are benzoyl peroxide and t-butyl perbenzoate. Mixtures of two or more of the above peroxides can also be used. Naturally, handling of the peroxides should be done with the utmost care due to their tendency to decompose or violently react. The user should be thoroughly familiar with their properties as well as proper handling procedures.

Examples of suitable organic azo initiators include 2,2'-azobis(2-methyl-propionitrile), 2,2'-azobis(2-methylvaleronitrile), and 4,4'-azobis(4-cyanovaleric acid).

The extent of the reaction of the carboxylic reactant onto the polyolefin can be measured by the total acid number ("TAN"), defined as the mg of KOH required to neutralize the acid functional groups of one gram of the graft polymer. The TAN is desirably 0.1 to 60, preferably 0.5 to 20.

As an alternative to the solvent-free reaction, a solvent grafting process can be employed. The solvent used can be any common or conventional solvent known to those skilled in the art. Solvents include the various oils which are lubricating base stocks, such as natural or synthetic lubricating oils described in detail above. Other solvents include refined 100 to 200 Neutral mineral paraffinic or naphthenic oils, diphenyldodecanes, didodecylbenzenes, hydrogenated decene, oligomers, and mixtures of the above. The amount of oil or solvent should be adjusted such that the viscosity of the reaction mixture is suitable for mixing. Typically the oil can be 70 to 99 percent by weight of the total reaction mixture.

If the reaction is carried out in a solvent, the various reactants and initiators are generally the same as set forth above. The various reaction parameters, conditions, methods, and the like, are generally also the same as set forth above. Suitable reaction vessels or containers are generally used. In one embodiment, a mineral oil is initially added to a vessel in a desired amount and heated. The vessel can be initially purged with an inert gas such as nitrogen. Longer residence times are sometimes required for a solvent-based reaction, to react the generally larger amount of reactants contained in such a reaction vessel. Although the temperatures can be 100° C. to 300° C., they are commonly somewhat lower, e.g., 130° C. to 180° C., with 140° C. to 175° C. being preferred. The process is generally carried out by heating the solvent to a suitable reaction temperature. The polyolefin is then added and allowed to dissolve over a matter of hours. The carboxylic reactant is then added. The free radical initiator is subsequently added and the reaction is conducted at a suitable temperature. The initiator is preferably added slowly, for example dropwise over a period of many minutes or even hours. After the addition is complete, the mixture is held at reaction temperature until a desired yield is obtained, typically for ½ to 2 hours. Naturally, shorter or longer time periods an be used if desired.

If the solvent is a mineral oil, one of the products of the functionalizing reaction can be acid-functionalized oil, which can serve as a co-thickening agent, as described above.

More detailed information on free radical grafting reactions of the solvent-free and solvent type can be found in PCT publication WO 87/03890.

Grafting can also occur by an "ene" reaction whereby an unsaturated comonomer reacts with a site of unsaturation on the polymer chain via a cyclic reaction to result in grafting of the monomer. The site of unsaturation on the copolymer chain can be a byproduct of the initial polymerization reaction or it can be introduced intentionally by copolymerization with a diene such as 1,3-butadiene or norbornadiene.

It will be understood that the polyolefins of this invention which are grafted can be present as a single polymeric species or as a mixture of polymers, and that mixtures of grafted polymers can be used in the compositions of the present invention, so long as the functional majority of the polymer which is used has the characteristics described above.

The amount of the grafted polyolefin used in the compositions of the present invention is an amount sufficient to increase the stiffness of the composition as measured by the above-described ASTM cone penetration test, compared to the stiffness in the absence of this component. It is recognized, of course, that the grafted polyolefin is not the only component of the composition which affects the stiffness of the grease; indeed, it is believed that the grafted polyolefin may cooperate with the metallic species and perhaps also the co-thickening agent to lead to an increase in thickness. In any event, the amount of the grafted polyolefin in the composition should normally be 0.1 to 10 weight percent, and preferably 0.5 to 5 weight percent. The actual amount employed will depend, of course, on the degree of thickening or other property modification that is desired. The amount used will also depend to some extent on the amount of acid functionality which is grafted onto the polyolefin: smaller amounts of highly grafted polymer may be used or larger amounts of lightly grafted polymer may be required. When the polymer is grafted with carboxylic acid functionality, it is preferred that the amount of polymer in the composition be such that the carboxylic acid functionality derived from the polymer amount to 0.001 to 0.1 weight percent of the composition. Preferably the amount of carboxylic acid functionality derived from the grafted polymer in the composition will be 0.005 to 0.05 weight percent. Thus, for example, if a composition contains 2 weight percent grafted polyolefin, and the polyolefin chains contain on average 0.5 weight percent carboxylic acid (as —COOH), the overall composition will contain 0.01 weight percent carboxylic acid functionality derived from the grafted polyolefin.

The metallic species.

The final major component of the present invention is a metallic species capable of interacting with the acid functionality of the polyolefin to cause association among the acid groups. The metallic species is generally a metal of the same sort that has been described above in connection with the co-thickening agent or metal soap, and indeed, the metallic species can be supplied, if desired, along with or even as a part of the co-thickening agent. Nevertheless, the metallic species is considered as a separate element of the present invention. Thus the metallic species can also be supplied as a salt or an oxide or hydroxide. It can also be supplied as an overbased salt. The metal can be supplied separately from the grafted polyolefin, such that the two species interact in situ to cause aggregation among the acid groups, or the polymeric acid groups can be prereacted with the metal and be added in the form of salts. Such partially or fully neutralized acidic polymer chains are sometimes referred to as ionomers; these materials are commercially available from a variety of sources. The only important feature in regard to the metallic species is that the metal ions should either be or become at least in part associated with the grafted acid functionality of the polyolefin. If the metallic species is added separately from the grafted polyolefin, the metal ions should have sufficient solubility or mobility in the medium under conditions of mixing that they can become at least in part associated with, neutralize, or otherwise interact with the acid groups in order to impart a measure of association among those groups.

The amount of the metallic species is an amount sufficient to promote a measure of association among the acid groups of the acid polymer. Preferably the amount is an amount sufficient to neutralize a substantial fraction of the total acid groups in the composition, from whatever source derived. More preferably the amount is sufficient to neutralize substantially all of the acid functionality in the composition. If one component of the composition is an overbased material (described in greater detail below), then the amount of the metallic species can be considerably in excess of the amount required to neutralize the acid functionality of the components of the composition.

The gelled overbased material.

In one embodiment, the co-thickening agent and the metallic species can be considered to be supplied together in the form of an overbased material, and preferably a gelled overbased material. In this case, the overall composition comprises a gelled overbased material dispersed in an oleophilic liquid medium, and a polymer containing acid functionality, as described in detail above.

Overbased materials are well known materials. Overbasing, also referred to as superbasing or hyperbasing, is a means for supplying a large quantity of basic material in a form which is soluble or dispersible in oil. Overbased products have been long used in lubricant technology to provide detergent additives.

Overbased materials are generally single phase, homogeneous systems characterized by a metal content in excess of that which would be present according to the stoichiometry of the metal and the particular acidic organic compound reacted with the metal. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention often have a metal ratio of 1.5 to 30, preferably 3 to 25, and more preferably 7 to 20.

Overbased materials are prepared by reacting an acidic material, normally an acidic gas such as $SO_2$ or $CO_2$, and most commonly carbon dioxide, with a mixture comprising an acidic organic compound, a reaction medium normally comprising an oleophilic medium, a stoichiometric excess of a metal base, and preferably a promoter.

The oleophilic medium used for preparing and containing overbased materials will normally be an inert solvent for the acidic organic material. The oleophilic medium can be an oil or an organic material which is readily soluble or miscible with oil. Suitable oils include oils of lubricating viscosity, including those which have been described above.

The acidic organic compounds useful in making overbased compositions include carboxylic acids, sulfonic acids, phosphorus-containing acids, phenols or mixtures of two or more thereof. The preferred acid materials are carboxylic acids. (Any reference to acids, such as carboxylic, or sulfonic acids, is intended to include the acid-producing derivatives thereof such as anhydrides, alkyl esters, acyl halides, lactones and mixtures thereof unless otherwise specifically stated.)

The carboxylic acids useful in making overbased salts may be aliphatic or aromatic, mono- or polycarboxylic acid or acid-producing compounds. These carboxylic acids include lower molecular weight carboxylic acids as well as higher molecular weight carboxylic acids (e.g. having more than 8 or more carbon atoms). Carboxylic acids, particularly the higher carboxylic acids, are preferably soluble in the oleophilic medium. Usually, in order to provide the desired solubility, the number of carbon atoms in a carboxylic acid should be at least 8, e.g., 8 to 400, preferably 10 to 50, and more preferably 10 to 22.

The carboxylic acids include saturated and unsaturated acids. Examples of such useful acids include dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene (Mn=200–1500), polypro-penyl-substituted succinic acid derived from a polypropene, (Mn=200–1000), octadecyl-substituted adipic acid, chlorostearic acid, 12-hydroxystearic acid, 9-methylstearic acid, dichlorostearic acid, ricinoleic acid, lesquerellic acid, stearyl-benzoic acid, eicosanyl-substituted naphthoic acid, dilauryl-decahydronaphthalene carboxylic acid, mixtures of any of these acids, their alkali and alkaline earth metal salts, their ammonium salts, their anhydrides, and/or their esters, triglycerides, etc. A preferred group of aliphatic carboxylic acids includes the saturated and unsaturated higher fatty acids containing from 12 to 30 carbon atoms. Other acids induce aromatic carboxylic acids including substituted and non-substituted benzoic, phthalic and salicylic acids or anhydrides, most especially those substituted with a hydrocarbyl group containing 6 to 80 carbon atoms. Examples of suitable substituent groups include butyl, isobutyl, pentyl, octyl, nonyl, dodecyl, and substituents derived from the above-described polyalkenes such as polyethylenes, polypropylenes, polyisobutylenes, ethylene-propylene copolymers, oxidized ethylene-propylene copolymers, and the like. Suitable materials also include derivatives functionalized by addition of sulfur, phosphorus, halogen, etc.

Sulfonic acids are also useful in making overbased salts and include the sulfonic and thiosulfonic acids. The sulfonic acids include the mono- or polynuclear aromatic or cycloaliphatic compounds. The oil-soluble sulfonates can be represented for the most part by one of the following formulae: $R_2$—T—$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1.

Phosphorus-containing acids are also useful in making basic metal salts and include any phosphorus acids such as phosphoric acid or esters; and thiophosphorus acids or esters, including mono and dithiophosphorus acids or esters. Preferably, the phosphorus acids or esters contain at least one, preferably two, hydrocarbyl groups containing from 1 to about 50 carbon atoms. The phosphorus-containing acids useful in the present invention are described in U.S. Pat. No. 3,232,883.

The phenols useful in making basic metal salts are generally represented by the formula $(R_1)_a$—Ar—$(OH)_b$, wherein $R_1$ is a hydrocarbyl group; Ar is an aromatic group; a and b are independently numbers of at least one, the sum of a and b being in the range of two up to the number of displaceable hydrogens on the aromatic nucleus or nuclei of Ar. $R_1$ and a are preferably such that there is an average of at least about 8 aliphatic carbon atoms provided by the $R_1$ groups for each phenol compound. The aromatic group as represented by "Ar" can be mononuclear such as a phenyl, a pyridyl, or a thienyl, or polynuclear.

The metal compounds useful in making the basic metal salts are generally any Group I or Group II metal compounds (CAS version of the Periodic Table of the Elements). The Group I metals of the metal compound include alkali metals (sodium, potassium, lithium, etc.) as well as Group IB metals such as copper. The Group I metals are preferably sodium, potassium, lithium and copper, more preferably sodium or potassium, and more preferably sodium. The Group II metals of the metal base include the alkaline earth metals (magnesium, calcium, barium, etc.) as well as the Group IIB metals such as zinc or cadmium. Preferably the Group II metals are magnesium, calcium, barium, or zinc, preferably magnesium or calcium, more preferably calcium. Generally the metal compounds are delivered as metal salts. The anionic portion of the salt can be hydroxyl, oxide, carbonate, borate, nitrate, etc.

Promoters are chemicals which are sometimes employed to facilitate the incorporation of metal into the basic metal compositions. Among the chemicals useful as promoters are water, ammonium hydroxide, organic acids of up to about 8 carbon atoms, nitric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include methanol, ethanol, isopropanol, dodecanol, behenyl alcohol, ethylene glycol, monomethyl ether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols. It is characteristic of promoters that they are normally employed in low quantities, normally at less than 1–2% by weight of the reaction mixture for promoters which are not later removed. Thus they do not normally constitute an appreciable portion of the acid functionality of the composition, but serve rather a role more as a catalyst for the overbasing process.

In preparing overbased materials, the organic acid material to be overbased normally is brought together in an inert oleophilic medium, with the metal base, the promoter, and the carbon dioxide (introduced by bubbling gaseous carbon dioxide into the mixture), and a chemical reaction ensues. The reaction temperature is usually about 27–159° C. (80°–300° F.), more often about 38–93° C. (100°–200° F.). The exact nature of the resulting overbased product is not known, but it can be described as a single phase homogeneous mixture of the solvent and either (1) a metal complex formed from the metal base, the carbon dioxide, and the organic acid and/or (2) an amorphous metal salt formed from the reaction of the carbon dioxide with the metal base and the organic acid. For purposes of the present invention the overbased material can be described as a mixture of a metal salt of an organic acid material with a metal carbonate.

A more complete description of the process for preparing ordinary overbased materials can be found in U.S. Pat. No. 3,766,067, McMillen. An alternative method for preparing, in particular, overbased saturated carboxylates is disclosed in greater detail in U.S. patent application Ser. No. 08/130,952, filed Oct. 4, 1993 now U.S. Pat. No. 5,401,424, Vinci et al.

The overbased material of this aspect of the invention can be used as an additive without further treatment, but it is preferably first converted to a gel to function more effectively as a co-thickening agent. This conversion can be effected by the method set forth in U.S. Pat. No. 3,492,231, McMillen.

An improved gelation process for, in particular, overbased saturated carboxylates is set forth in the above-mentioned U.S. patent application Ser. No. 08/130,952, filed Oct. 4, 1993. In summary, the initial overbased material which is further converted to a gel is a mixture containing a salt of at least one organic acid material of at least 8 carbon atoms and a salt of at least one organic material of fewer than 6 carbon atoms, or a mixed salt containing such higher and lower acid materials. The salt of the organic acid material of at least 8 carbon atoms can be the overbased saturated carboxylic acid. This overbased mixture, however, can be prepared by overbasing a mixture of the higher acid and the lower acid, or by adding a metal salt of the lower acid to an overbased composition of the higher acid, or by adding to an overbased composition of the higher acid a substance which forms a metal salt of the lower acid upon interacting with a metal base, or by any equivalent methods. It is convenient, for example, to prepare the mixture by premixing equivalent amounts of a lower acid (such as acetic acid) and a metal base (such as calcium hydroxide) in an inert vehicle (such as mineral oil) and admixing the thus prepared mixture with an overbased composition prepared as described above.

The amount of carbonated overbased material normally will comprise 1 to 70 weight percent, and preferably 10 to 50 weight percent, of the overall composition to be gelled.

The higher acid used in this aspect of the present invention is an acid containing at least 8 carbon atoms. It is preferably a carboxylic acid containing 10 to 22 carbon atoms. The lower acid used in this aspect of the present invention is an organic acid containing fewer than 6 carbon atoms, and preferably 1 to 4 carbon atoms. Preferred lower acids include formic acid, acetic acid, propionic acid, butyric acid, valeric acid, branched chain isomers of such acids, and mixtures of such acids. The most preferred lower acid is acetic acid, although materials functionally equivalent to acetic acid (erg. acetic anhydride, ammonium acetate, acetyl halides, or acetate esters) can also be used.

Ordinary overbased materials can be gelled, i.e. converted into a gel-like or colloidal structure, by homogenizing a "conversion agent" and the overbased starting material. The term "conversion agent" is intended to describe a class of very diverse materials which possess the property of being able to convert the Newtonian homogeneous, single-phase, overbased materials into non-Newtonian colloidal disperse systems. The mechanism by which conversion is accomplished is not completely understood. The conversion agents include lower aliphatic carboxylic acids, water, aliphatic alcohols, polyethoxylated materials such as polyglycols, cycloaliphatic alcohols, arylaliphatic alcohols, phenols, ketones, aldehydes, amines, boron acids, phosphorus acids, sulfur acids, and carbon dioxide (particularly in combination with water). Gelation is normally achieved by vigorous agitation of the conversion agent and the overbased starting materials, preferably at the reflux temperature or a temperature slightly below the reflux temperature, commonly 25° C. to 150° C. or slightly higher. Conversion of overbased materials to a colloidal disperse system is described in more detail in U.S. Pat. No. 3,492,231 (McMillen).

The function of the organic acid having. fewer than 6 carbon atoms is believed to be to aid in the gelation of the overbased material. The amount of the organic acid material having fewer than 6 carbon atoms is an amount suitable to provide a measurable increase in the rate of conversion or gelation of the overbased composition, when the overbased material is formed from a saturated carboxylic acid. More specifically, the molar ratio of the acid of fewer than 6 carbon atoms to the acidic organic material of at least 8 carbon atoms is preferably 0.2:1 to 5:1, and more preferably 0.5:1 to 2:1. When less than 0.2 parts are used the increase in rate is less pronounced, and when more than 5 parts are used there is little further practical advantage to be gained. Within approximately this range, the rate of gelation increases with increasing content of the lower acidic organic material.

The gelled material obtained by the above or any equivalent processes can be used without further treatment. However, it is often desirable to remove the volatile materials, including water and alcohol conversion agents, from the composition. This can be effected by further heating the composition to 100–200° C. for a sufficient length of time to achieve the desired degree of removal. The heating may be conducted under vacuum if desired, in which case the temperatures and times can be adjusted in a manner which will be apparent to the person skilled in the art.

It is further possible to completely isolate the solid components of the gelled material as dry or nearly dry solids. (In this context the term "solid" or "solids" includes not only sensibly dry materials, but also materials with a high solids content which still contain a relatively small amount of residual liquid.) Isolation of solids can be effected by preparing the composition in an oleophilic medium which is a volatile organic compound, that is, one which can be removed by evaporation. Xylenes, for example, would be considered volatile organic compounds. Heating of the gel to a suitable temperature and/or subjecting it to vacuum can lead to removal of the volatile oleophilic medium to the extent desired. Typical methods of drying include bulk drying, vacuum pan drying, spray drying, flash stripping, thin film drying, vacuum double drum drying, indirect heat rotary drying, and freeze drying. Other methods such as dialysis, precipitation, extraction, filtration, and centrifugation can also be employed to isolate the solid components, even if the medium is not volatile. The solid material thus isolated may be stored or transported in this form and later recombined with an appropriate amount of a medium such as an oleophilic medium (e.g. an oil). The solids materials, when dispersed in an appropriate medium, can provide a grease. The gelled material serves as a co-thickening agent for the grease.

It is also possible to prepare a dispersion of a gel in an oil or in an oleophilic medium different from that in which the gel was originally prepared, i.e., a "replacement medium," by a solvent exchange process. Removal of the original liquid medium can be effected other physical or chemical methods appropriate to the specific combination of materials at hand, which will be apparent to one skilled in the art.

The components of the present invention can be combined by any conventional means suitable for forming a grease. Typically a mixer is charged with oil, a co-thickener, other desired additives, and the functionalized polymer of the present invention. Separately, a metal ion source is dissolved in water. The two mixtures are combined and heated to permit reaction to occur, while removing water by distillation. The resulting product, to which additional oil can be added if desired, can be worked on a mill to provide the desired grease.

Alternatively, the components of the present invention can be prepared as one or more concentrates. A typical concentrate will consist essentially of a polyolefin having grafted acid functionality, as described in detail above, a co-thickening agent, as described above, and a concentrate-forming amount of an oleophilic medium. The oleophilic medium is generally an oil of lubricating viscosity and it can be, if desired, an acid-functionalized oil, prepared as described above during the preparation of the grafted polyolefin. In this case the acid-functionalized oil can serve as a co-thickening agent as well. The concentrates of this invention will normally be substantially free from the metallic species which is eventually employed to cause association among the acid groups, since the presence of a large amount of such metal could tend to cause premature gelation of the concentrate, thus reducing its effectiveness. Likewise, such concentrates should preferably be substantially free from other ionic species or polyfunctional materials such as polyamines which could lead to premature crosslinking. The particular amounts which could be tolerated will depend, of course, on the specific materials involved and can be readily determined by those of skill in the art.

In the concentrate of this invention, the amount of the oleophilic medium, such as an oil, will be less than in the fully formulated composition. The amount of oleophilic medium will be at least the minimum amount required to provide the desired physical properties such as improved handleability. Relatively small amounts of oil can be added to form an oil-extended solid composition; larger amounts can be used to provide a fluid concentrate. Suitable amounts of oleophilic medium in the concentrate can broadly be 5 to 98% by weight; preferably the amount of oleophilic medium will be 50 to 95%, and more preferably 80 to 90%. The amounts of the active ingredients in a concentrate will normally be increased, compared to the amount present in a final formulation, corresponding to the reduction in the amount of the oleophilic medium or oil. Preferably the grafted olefin will comprise 3 to 30 percent by weight of the concentrate. Generally the relative amounts of the polyolefin and the co-thickening agent will be about the same as has been described above for the composition of the fully formulated product.

If the material of the present invention is used as a concentrate, it can be used to prepare fully formulated materials by methods which will be apparent to those skilled in the art. In particular, the concentrate containing the polyolefin with grafted acid functionality and the co-thickening agent can be combined with an oil of lubricating viscosity and the metallic species, with appropriate heating, to prepare a grease. Other materials such as extreme pressure additive can be included to prepare a fully compounded grease.

As used herein, the term "hydrocarbyl substituent" or "hydrocarbyl group" means a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

EXAMPLES

Example 1

Preparation of Functionalized Polymer

To a 5 L, four-necked flask equipped with a stirrer, nitrogen inlet, subsurface tube, thermowell, and condenser, is charged 2121 g of stock mineral oil (#151). The oil is stirred and heated to 160° C. under a nitrogen flow of about 8 L/hr (0.3 SCFH). To the flask is added 374.3 g LZ® 7060 ethylenelpropylene/dicyclopentadiene polymer, number average molecular weight about 115,000 (from The Lubrizol Corporation), in the form of 1 cm cubes, over the course of about 1 hour. The mixture is thereafter stirred for an additional 2 hours and allowed to cool overnight.

The mixture is heated under nitrogen to 160° C. with stirring for 3 hours. Maleic anhydride, 3.8 g, is added and the mixture stirred for an additional 15 minutes. To the mixture is added 3.8 g di-t-butyl peroxide, dropwise, over 1 hour at 160° C. The temperature is maintained for an additional 2.5 hours; thereafter the nitrogen flow is increased to 42 L/hr (1.5 SCFM for 1.5 hours. The flask is cooled and sealed overnight. The mixture is heated under nitrogen for an additional 3 hours at 160° C. Upon cooling the product (without further isolation) is maleic anhydride functionalized olefin copolymer in oil.

Example 2

Preparation of Functionalized Polymer

To a 5 L, four-necked flask equipped with a stirrer, nitrogen inlet, subsurface tube, thermowell, and condenser, is charged 2428 g of stock mineral oil (#151). The oil is stirred and heated to 160° C. under a nitrogen flow of about 11 L/hr (0.4 SCFH). To the flask is added 240 g LZ® 7060 polymer in the form of 1 cm cubes, over the course of about 45 minutes. The mixture is thereafter stirred for an additional 2.5 hours and allowed to cool overnight.

The mixture is heated under nitrogen to 130° C. with stirring. Maleic anhydride, 36 g, is added. To the mixture is added 36 g t-butyl peroxybenzoate in 20 g toluene, over 2 hours. The reaction is maintained at 130° C. for an additional 3 hours; thereafter the flask is cooled . The product (without further isolation) is maleic anhydride functionalized olefin copolymer in oil.

Example 3

Preparation of Functionalized Polymer

To a 12 L four-necked flask is added 2607.9 g of a solution of 10% LZ® 7341 styrene-butadiene copolymer rubber, number average molecular weight about 150,000 (from The Lubrizol Corporation), in oil. The oil is heated to 130° C. with stirring under a nitrogen flow of about 1.4 L/hr (0.05 SCFH). To the flask is added 27.3 g maleic anhydride, followed by stirring at temperature for 20 minutes. To the mixture is added, dropwise over 2 hours, a solution of 6.6 h t-butylperoxybenzoate in 30 g toluene. After addition is complete the mixture is stirred for an additional 4 hours at 130° C. The product is vacuum stripped at 150° C. and 2.7 kPa (20 mm Hg). The product (without further isolation) is maleic anhydride functionalized styrene butadiene copolymer rubber in oil.

Example 4

Preparation of Functionalized Polymer

To a 12 L four-necked flask is added 2500 g of a solution of 10% the LZ® 7341 styrene butadiene copolymer rubber, in oil. The oil is heated to 130° C. with stirring under a nitrogen flow of about 3 L/hr (0.1 SCFH). To the flask is added 75 g maleic anhydride, followed by stirring at temperature for 20 minutes. To the mixture is added, dropwise over 2 hours, a solution of 18.8 g t-butylperoxybenzoate in 58.3 g toluene. After addition is complete the mixture is stirred for an additional 4 hours at 130° C. The product is vacuum stripped at 150° C. and 2.7 kPa (20 mm Hg). The product (without further isolation) is maleic anhydride functionalized styrene butadiene copolymer rubber in oil.

Example 5

Preparation of Grease

To a large Hobart™ mixer is charged 2400 g of 800 SUS lubricating oil, 268 g 12-hydroxy stearic acid, 10 g naphthenic acid, 2 g antifoam agent from Dow Corning, and 368 g of a 10%o solution of LZ® 7060 hydrocarbon copolymer rubber, functionalized in solution process with maleic anhydride to a total acid number (for the polymer) of 10. The mixture is heated to 80° C.

In a separate container, 44 g $LiOH.H_2O$, 160 g water, and 1.6 g calcium hydroxide are charged and heated to 80° C. with stirring.

The two mixtures are combined and slowly heated to 100° C. Water is continuously removed over 1.5 hours. After removal is complete the mixture is heated to 198° C. over 45 minutes and held at temperature for an additional 30 minutes. Heating is discontinued and the reaction is allowed to cool to 170° C. over 15 minutes. The pH of the mixture is measured to confirm proper incorporation of the base (found: 10.2. expected: 10–11). To the reaction miture is added 906.5 g additional 800 SUS mineral oil over 5 minutes. The mixture is cooled to 80° C.

The mixture is milled on a Sonic Trihomo™ mill for 1 pass. The resulting material is a grease which has the following physical characteristics:

Penetration (ASTM D-217):

0 stroke: 264

60 stroke: 253

10,000 stroke: 248

Water spray off (ASTM D-4049): 13.5%

Dropping point (ASTM D-2265): 180° C.

Example 6

Preparation of Grease

Example 5 is substantially repeated except that the functionalized polymer has a total acid number of 30. The final addition of 800 SUS mineral oil is 910.5 g. The grease which is prepared has the following properties:

Penetration (ASTM D-217):

0 stroke: 303

60 stroke: 300

10,000 stroke: 293

Water spray off(ASTM D-4049): 15%

Dropping point (ASTM D-2265): 196° C.

Example 7

Preparation of Grease

To the apparatus of Example 5 is charged 2731 g of 800 SUS lubricating oil, 268 g 12-hydroxystearic acid, 10 g naphthenic acid, 2 g antifoam agent from Dow Corning, and 36 g LZ® 2002 functionalized ethylenelpropylenetdiene rubber in solid form containing 0.4 weight percent acid functionality calculated as maleic anhydride (from The Lubrizol Corporation). The mixture is heated to 110° C. and maintained at temperature 15 niinutes, thereafter cooled to 80° C.

In a separate beaker is charged 44 g $LiOH.H_2O$, 160 g water, and 1.6 g calcium hydroxide. The mixture is heated to 80° C.

The two mixtures are combined at 80° C., mixed, and heated to 100° C., holding at temperature for 1–1.5 hours to remove the water. Thereafter the mixture is heated to 198° C., then cooled to 170° C. The pH is measured, and 906.6 g 800 SUS mineral oil is slowly added over 10 minutes. The mixture is cooled to 80° C.

The mixture is milled on a Charlotte™ mill for one pass. The grease which is prepared has the following properties:

Penetration (ASTM D-217):

0 stroke: 281

60 stroke: 298

10,000 stroke: 297

Water spray off(ASTM 1)4049) triplicate runs: 0.06%, 12.7%, 11.9%.

Example 8

Preparation of Grease

To a 9.5 L (2.5 gallon) Pilot™ mixer is charged 5890.5 g of 800 SUS lubricating oil, 569.5 g 12-hydroxystearic acid, and 85 g LZ® 2002 functionalized rubber. The mixture is heated to 82–93° C. (180–200° F.).

In a separate beaker are mixed 3.4 g calcium hydroxide, 425 g water, and 116.9 g $LiOH.H_2O$, and heated to 71–82° C. (160–180° F.).

The two mixtures are slowly combined and heated to 93–121° C. (200–250° F.) and maintained at temperature for 1–1.5 hours. Thereafter the mixture is heated to 193–199° C. (380–390° F.) and held at temperature for 15 minutes. To the mixture is added 3084.7 g 800 SUS oil over a period of 10 minutes, providing cooling to 88° C. (190° F.), followed by slow addition of 250 g of a standard grease performance additive package (LZ® 5230 additive, from The Lubrizol Corporation) The mixture is stirred at temperature for ½ hour.

The mixture is milled on a Charlotte™ mill for one pass. The grease which is prepared has the following properties:

Penetration (ASTM D-217):

0 stroke: 258

60 stroke: 320

10,000 stroke: 335

Water spray off (ASTM D-4049): 3.4%

Example 9 (reference)

Preparation of Grease

To a Hobart™ mixer is charged 268 g 12-hydroxystearic acid, 10 g naphthenic acid, 2 g antifoam agent from Dow Corning, and 1839.2 g 800 SUS oil. The mixture is heated to 82° C.

In a separate beaker is combined 40 g $LiOH.H_2O$, 1.6 g calcium hydroxide, and 240 g water. The mixture is heated to 82° C.

The contents of the beaker (at 82° C.) are added to the mixture in the Hobart™ mixer. The combined mixture is heated to 100° C. for 1.5 hours, then to 198° C. over 30 minutes. The mixture is cooled to 160° C. and a solution of 4% LZ® 7060 olefin rubber, not functionalized, in oil, is added over a period of 20 minutes. The mixture is cooled to 50° C. and milled for one pass on a Charlotte™ mill. The grease which is prepared has the following properties:

Penetration (ASTM D-217):

0 stroke: 300

60 stroke: 295

10,000stroke: 310

Water spray off (ASTM D-4049): 64%

Dropping point (ASTM D-2265): 187° C.

Example 10

Functionalized polymer in gelled overbased carboxylate grease

To a large flask is charged 1000 g of a 500 N paraffinic oil, 1000 g of a paraffinic bight stock, and 100 g of a 10% solution of the maleic anhydride functionalize styrene-butadiene copolymer rubber from Example 3. The mixture is heated to 50° C. with continuous stirrm& then stirred for 30 minutes at temperature. To the mixture is added 800 g of a calcium overbased tallate, 800 conversion, 63% chemical in diluent oil. There is further added 65 g calcium hydroxide, 250 g isopropyl alcohol, and 65 g water. The mixture is heated to 50° C. To this mixture is added a solution of 60 g glacial acetic acid and 60 g water, dropwise over 15 minutes, while maintaining the temperature at 50–60° C.

The reaction mre is heated to reflux at about 82° C. for about 2.5 hours to effect full gellation. The mixture is heated to 125° C. and swept with nitrogen at 14 L/hr (0.5 SCFH), thereby removing 379.4 g of solvent and water.

The mixture is cooled milled for one pass on a 3-roll mill. The grease which is prepared has the following properties:

Penetration (ASTM D-217):

0 stroke: 273

60 stroke: 294

10,000 stroke: 308

Water spray off (ASTM D-4049): 70.5%

Example 11 (reference)

Example 10 is substantially repeated except that the functionalized styrene-butadiene polymer is omitted. The grease which is prepared has the following properties:

Penetration (ASTM D-217):

0 stroke: 307

60 stroke: 339

10,000 stroke: 343

Water spray off (ASTM D-4049): 99.7%

Example 12 (reference)

Example 10 is substantially repeated except that the functionalized styrene-butadiene polymer is replaced by a corresponding amount of the same polymer without maleic anhydride functionalization. The grease which is prepared has the following properties:

Penetration (ASTM D-217):

0 stroke: 294

60 stroke: 313

10,000 stroke: 328

Water spray off (ASTM D-4049): 98.7%

Example 13 (reference)

Example 10 is substantially repeated except that the functionalized styrene-butadiene polymer is replaced by a corresponding amount of Shellvis™ 40, a styrene-isoprene block copolymer of similar molecular weight to that of Example I, without maleic anhydride functionalization. The grease which is prepared has the following properties:

Penetration (ASTM D-217):

0 stroke: 311

60 stroke: 323

10,000 stroke: 336

Water spray off (ASTM D-4049): 98.3%

Each of the documents referred to above is incorporated herein by reference. Except in the Examples, or where otherwise explicitly indicated, all numerical quantities in this description specifying amounts of materials, reaction conditions, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A grease composition comprising.

(a) an oil of lubricating viscosity;

(b) about 0.1 to about 10 weight percent of a polyolefin having grafted carboxylic acid functionality, wherein the grafted polyolefin is an α-olefin/diene copolymer or a hydrogenated α-olefin/diene copolymer, said polyolefin having a number average molecular weight of at least about 50,000;

(c) a metallic species selected from the group consisting of alkali metals, alkaline earth metals, and aluminum, capable of interacting with the acid functionality of said polyolefin to cause association among the acid groups; and (d) a co-thickening agent selected from the group consisting of simple metal soap thickeners, soap complexes, non-soap thickeners, oils functionalized by grafting reaction with ethylenically unsaturated mono- or dicarboxylic acids having 4 to 10 carbon atoms, and metal salts of such acid-functionalized oils;

said polyolefin being present in an amount sufficient to increase the viscosity of the composition; said polyolefin having been combined with the other components under grease-forming conditions of heating and mixing to form the grease composition;

wherein the amount of carboxylic acid functionality derived from the grafted polymer in the composition is about 0.001 to about 0.1 weight percent.

2. The composition of claim 1 wherein the grafted polyolefin is soluble in said oil.

3. The composition of claim 1 wherein the polyolefin contains about 0.001 to about 1 weight percent carboxylic acid functionality.

4. The composition of claim 1 wherein the polyolefin has a melt index of up to about 20 dg/min.

5. The composition of claim 1 wherein the polyolefin contains about 0.001 to about 5 weight percent carboxylic acid functionality.

6. The composition of claim 1 wherein the amount of the grafted polyolefin is sufficient to increase the stiffness of the composition as measured by cone penetration.

7. The composition of claim 1 wherein the metal is lithium.

8. The composition of claim 1 wherein the co-thickening agent comprises a metal soap or an acidic material which interacts with the metallic species of (c) to form a metal soap.

9. The composition of claim 1 wherein the grafted polymer is an elastomeric polyolefin.

10. The composition of claim 8 wherein the metal soap is a salt of 12-hydroxystearic acid.

11. The composition of claim 1 wherein the co-thickening agent comprises an acid-functionalized oil.

12. The composition of claim 1 wherein the polyolefin is a styrene/diene copolymer or a hydrogenated styrene/diene copolymer.

13. The composition of claim 1 wherein the grafted carboxylic acid functionality is derived from maleic anhydrides or an acid or ester thereof.

14. The composition of claim 1 wherein the amount of the metallic species is at least sufficient to neutralize substantially all of the acidic components in the composition.

15. A concentrate consisting essentially of:

about 3 to about 30 weight percent of a polyolefin having grafted carboxylic acid functionality, wherein the grafted polyolefin is an α-olefin/diene copolymer or a hydrogenated α-olefin/diene copolymer, said polyolefin having a number average molecular weight of at least about 50,000 and said polyolefin containing about 0.001 to about 5 weight percent carboxylic acid functionality;

a co-thickening agent selected from the group consisting of simple metal soap thickeners, soap complexes, non-soap thickeners, oils functionalized by grafting reaction with ethylenically unsaturated mono- or di-carbaoxylic acids having 4 to 10 carbon atoms, and metal salts of such acid-functionalized oils; and about 5 to about 98 percent by weight of an oil of lubricating viscosity.

16. The concentrate of claim 15 wherein the oil of lubricating viscosity is an acid-functionalized oil.

17. The concentrate of claim 15 wherein the co-thickening agent is an acid-functionalized oil.

18. A grease composition comprising:

(a) an oil of lubricating viscosity;

(b) about 0.1 to about 10 weight percent of a polymer comprising at least one 1-olefin monomer of 2 to 18 carbon atoms and a diene, or a hydrogenated polymer of such monomers, said polymer having grafted carboxylic acid functionality derived from at least one ethylenically unsaturated mono- or di-carboxylic acid having 4 to 10 carbon atoms, said polymer having a number average molecular weight of at least 50,000;

(c) a metal ion selected from the group consisting of alkali metals, alka-line earth metals, and aluminum capable of interacting with the acid functionality of said polyolefin to cause association among the acid groups; and (d) a grease co-thickcening agent selected from the group consisting of simple metal soap thickeners, soap complexes, non-soap thickeners, oils functionalized by grafting reaction with ethylenically unsaturated mono- or di-carboxylic acids having 4 to 10 carbon atoms, and metal salts of such acid-functionalized oils;

the polymer of (b) being present in an amount sufficient to provide 0.001 to 0.1 weight percent carboxylic acid functionality to the composition and to improve the water spray-off performance of the grease composition as measured by ASTM D-4049; said polymer having been combined with the other components under grease-forming conditions of heating and mixing to form the grease composition.

19. The grease composition of claim 18 wherein the polymer of (b) comprises monomer units of styrene or substituted styrene.

20. The grease composition of claim 18 wherein said polymer is combined with the other components under conditions of mixing at about 100° C. to about 200° C. with removal of water.

21. A grease composition comprising:

(a) a gelled overbased mateal dispersed in (b) an oil of lubricating viscosity; and (c) about 0.1 to about 10 weight percent of a polyolefin containing grafted carboxylic acid functionality wherein the polyolefin is an α-olefin/diene copolymer or a hydrogenated α-olefin/diene copolymer, present in an amount sufficient to increase the viscosity of the composition, wherein the polymer has a number average molecular weight of at least about 50,000; said polymer having been combined with the other components under grease-forming conditions of heating and mixing to form the grease composition;

wherein the amount of carboxylic acid functionality in the composition is about 0.001 to about 0.1 weight percent.

22. The composition of claim 21 wherein the polymer has a melt index of up to about 20 dg/min.

23. The composition of claim 21 wherein the polymer contains about 0.001 to about 5 weight percent carboxylic acid functionality.

24. The composition of claim 21 wherein the gelled overbased material is a gelled overbased carboxylate material.

25. The composition of claim 24 wherein the gelled overbased carboxylate material dispersed in an oleophilic medium is obtained by preparing a mixture of (i) a fluid carbonated overbased material in an oleophilic medium, which mixture contains a metal salt of at least one organic acid material containing at least 8 carbon atoms, and (ii) an alcohol or an alcohol-water mixture; heating the mixture of (i) and (ii); and removing at least a portion of the volatile materials from said mixture.

26. The composition of claim 25 wherein the fluid carbonated overbased material of (i) also comprises a metal salt of at least one organic acid material containing fewer than 6 carbon atoms.

27. The composition of claim 21 wherein the polymer is an elastomeric polyolefin.

28. The composition of claim 21 wherein the graft monomer is derived from maleic anhydride or an acid or ester thereof.

29. A method for preparing a grease, comprising combining under grease-forming conditions of heating and mixing (a) an oil of lubricating viscosity;

(b) about 0.1 to about 10 weight percent of a polyolefin having grafted carboxylic acid functionality, wherein the grafted polyolefin is an α-olefin/diene copolymer or a hydrogenated α-olefin/diene copolymer, said polyolefin having a number average molecular weight of at least about 50,000;

(c) a metallic species selected from the group consisting of alkali metals, alkaline earth metals, and aluminum, capable of interacting with the acid functionality of said polyolefin to cause association among the acid groups; and (d) a co-thickening agent selected from the group consisting of simple metal soap thickeners, soap complexes, non-soap thickeners, oils functionalized by grafting reaction with ethylenically unsaturated mono- or di-carboxylic acids having 4 to 10 carbon atoms, and metal salts of such acid-functionalized oils wherein the amount of carboxylic acid functionality derived from the grafted polymer in the resulting grease composition is about 0.001 to about 0.1 weight percent.

30. The method of claim 29 wherein components (b) and (d) are present together in a concentrate which is combined with components (a) and (c).

31. The composition of claim 21 wherein the olefin copolymer is a styrene/diene copolymer or a hydrogenated styrene/diene copolymer.

* * * * *

UNITED STATES PATENT AND TRADEMARK OFFICE

CERTIFICATE OF CORRECTION

PATENT NO. : 6,300,288 B1 
DATED : October 9, 2001
INVENTOR(S) : Curtis R. Scharf, Steven R. Twining and Patricia R. Todd It is certified that error appears in the above-identified patent and that said Letters Patent is hereby corrected as shown below:

Column 24,
Line 34, correct "di-carbaoxylic" to read -- di-carboxylic --.
Line 55, correct "alka-line" to read -- alkaline --.

Column 25,
Line 13, correct the spelling of "mateal" to read -- material --.

Signed and Sealed this

Twentieth Day of August, 2002

*Attest:*

*Attesting Officer*

JAMES E. ROGAN
*Director of the United States Patent and Trademark Office*